US007009150B2

(12) United States Patent
Wennemann et al.

(10) Patent No.: US 7,009,150 B2
(45) Date of Patent: Mar. 7, 2006

(54) COOKING UNIT WITH A GLASS-CERAMIC OR GLASS PANEL MADE OF TRANSPARENT COLORLESS MATERIAL AND PROVIDED WITH AN IR PERMEABLE SOLID COLORED UNDERSIDE COATING

(75) Inventors: Dietmar Wennemann, Albig (DE); Susanne Rapp, Ruesselsheim (DE); Monica Cotlear De Witzmann, Nieder-Olm (DE); Peter Nass, Mainz (DE); Evelin Weiss, Mainz (DE); Dieter Schoenig, Mainz (DE)

(73) Assignee: Schott AG, Mainz (DE)

( * ) Notice: Subject to any disclaimer, the term of this patent is extended or adjusted under 35 U.S.C. 154(b) by 213 days.

(21) Appl. No.: 10/010,308

(22) Filed: Nov. 8, 2001

(65) Prior Publication Data

US 2002/0084263 A1 Jul. 4, 2002

(30) Foreign Application Priority Data

Nov. 11, 2000 (DE) ..... 200 19 210 U

(51) Int. Cl.
*H05B 3/68* (2006.01)

(52) U.S. Cl. ..... 219/452.11; 219/443.1; 219/460.1; 219/547; 428/428

(58) Field of Classification Search ..... 219/452.11, 219/460.1, 443.1, 463.1, 357, 449, 460.01, 219/547, 548; 123/39 R; 427/266, 265, 427/264; 501/21; 428/428
See application file for complete search history.

(56) References Cited

U.S. PATENT DOCUMENTS

| | | | | |
|---|---|---|---|---|
| 3,612,829 | A * | 10/1971 | Evans et al. | 219/464 |
| 4,237,368 | A * | 12/1980 | Welch | 219/449 |
| 4,426,570 | A * | 1/1984 | Hikino et al. | 219/354 |
| 4,665,307 | A * | 5/1987 | McWilliams | 219/449 |
| 5,716,712 | A | 2/1998 | Schoening et al. | |
| 6,051,817 | A * | 4/2000 | Morsch et al. | 219/460.1 |
| 6,299,940 | B1 * | 10/2001 | Rapp et al. | 427/266 |
| 6,448,539 | B1 * | 9/2002 | Ose et al. | 219/463.1 |
| 6,492,622 | B1 * | 12/2002 | Melson et al. | 219/412.11 |
| 6,505,621 | B1 * | 1/2003 | Gabelmann | 123/39 R |
| 6,525,300 | B1 * | 2/2003 | Mitra et al. | 219/443.1 |
| 2003/0019864 | A1 * | 1/2003 | Krause et al. | 219/460.1 |
| 2003/0141291 | A1 * | 7/2003 | Heidari et al. | 219/460.1 |

FOREIGN PATENT DOCUMENTS

| | | |
|---|---|---|
| DE | 24 37 026 A | 2/1976 |
| DE | 35 05 922 C1 | 10/1986 |
| DE | 34 33 880 C2 | 3/1987 |
| DE | 44 26 234 C1 | 3/1996 |

(Continued)

*Primary Examiner*—Robin O. Evans
*Assistant Examiner*—L Fastovsky
(74) *Attorney, Agent, or Firm*—Michael J. Striker

(57) ABSTRACT

The cooking unit has a glass-ceramic panel (1) providing a cooking surface, which is made of transparent colorless glass-ceramic bulk material or a glass panel made of pre-stressed transparent colorless glass material. Radiant heating elements (3) are provided under the glass or glass-ceramic panel, which heat respective cooking zones. The glass or glass-ceramic panel has a full surface decorative coating (7) on its upper side, which makes dirt and usage marks less conspicuous, and an IR permeable coating (6) having a solid or plain color, preferably bisque-like, on its underside. The IR permeable coating having the solid or plain color prevents an observer from viewing the internal components of the cooking unit that are under the cooking panel from above it.

16 Claims, 1 Drawing Sheet

FOREIGN PATENT DOCUMENTS

| | | | |
|---|---|---|---|
| DE | 297 11 916 | U | 8/1997 |
| DE | 197 28 881 | C1 | 9/1998 |
| DE | 197 21 737 | C1 | 11/1998 |
| DE | 200 05 461 | U | 6/2000 |
| DE | 200 05 461 | U1 | 7/2000 |
| EP | 0 195 239 | A | 9/1986 |
| EP | 0 220 333 | A1 | 5/1987 |
| EP | 0 693 464 | A1 | 1/1996 |
| JP | 7201462 | | 8/1995 |
| JP | 10273342 | | 10/1998 |

* cited by examiner

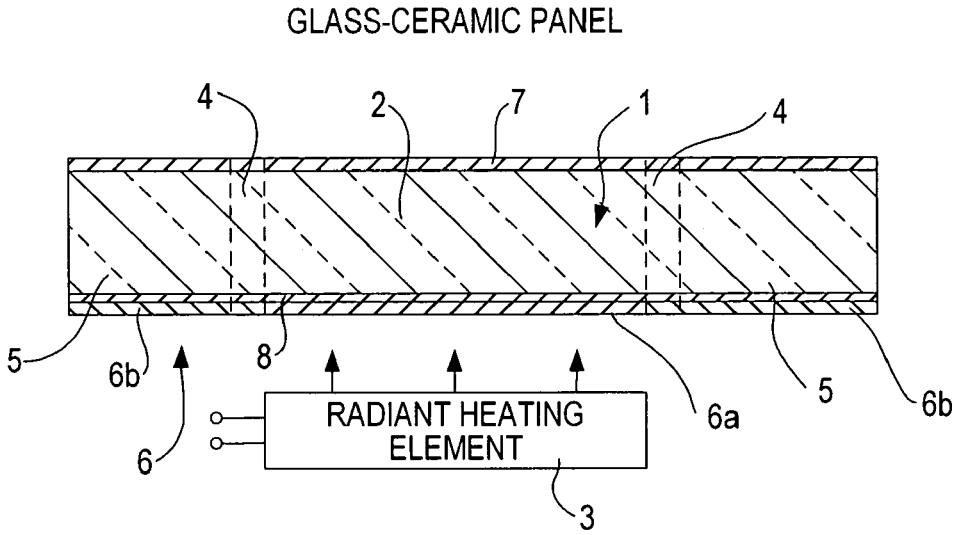
GLASS-CERAMIC PANEL
4
2
7
1
4
5
6b
8
6
RADIANT HEATING ELEMENT
6a
5
6b
3

COOKING UNIT WITH A GLASS-CERAMIC OR GLASS PANEL MADE OF TRANSPARENT COLORLESS MATERIAL AND PROVIDED WITH AN IR PERMEABLE SOLID COLORED UNDERSIDE COATING

BACKGROUND OF THE INVENTION

1. Field of the Invention

The present invention relates to a cooking device or range with a glass-ceramic panel made of transparent colorless material or, alternatively, with a glass panel made of pre-stressed special transparent colorless glass. The glass-ceramic or pre-stressed glass panel provides a cooking surface, which has cooking zones heated with respective radiant heating elements. More particularly the present invention relates to a glass-ceramic or pre-stressed glass panel of the above-described type on which a decoration is applied and whose underside has an IR transparent coating made of temperature-resistant paint.

2. Description of the Related Art

A cooking devices or ranges with glass-ceramic panels providing a cooking surface are currently state of the art. They typically have a glass-ceramic panel, as set forth in European Patent Document EP 0 220 333, which is colored in bulk with color-imparting ions that reduce transmission through the glass-ceramic panel. Thus the operating components of the cooking range underneath the glass-ceramic panel are practically not observable from above the range. This type of cooking surface is non-transparent for all practical purposes and appears black when observed from above.

Cooking surfaces formed on the above-described glass-ceramic panels are generally provided with decorations for purely esthetic reasons or to differentiate or highlight functional zones, e.g. cooking zones, from other regions of the cooking surface. These decorations and their application to glass-ceramic panels are, for example, described in German Patent Application DE 44 26 234 C1 (=EP 0 693 464 B1) and DE 34 33 880 C2.

On account of the non-transparency of the colored glass-ceramic panel the decorations on the cooking surface, including the full surface decorated cooking surfaces known, for example, from German Patent Application DE 197 28 881 C1 (=DE 297 11 916.8 U1) are either typically printed by means of screen-printing, or subsequently burned-in or applied to the upper side of the panel according to transfer technology, according to the state of the art with ceramic paint based on enamel. The top or upper side of the cooking surface is nearly completely covered with a decoration in the case of the full surface decorated cooking surface.

German Patent Application DE 200 05 461 U1 discloses cooking panels made from a transparent, colorless glass-ceramic bulk material and printed on their underside with temperature-resistant paint. These paint coatings first serve to make the cooking panel non-transparent i.e. they replace the otherwise common bulk coloring so that the panel appears dark from above. Furthermore the underside coating is a color-imparting decoration, while the upper side of the glass-ceramic panel is decoration free, i.e. it is not coated.

Because of the single coating on the underside of the glass-ceramic panel printed with a dark color, dirt or the like, such as fingerprints, on this known cooking panel is more conspicuousness than otherwise. Also there is no protection of the upper surface from scratches, metal abrasion and usage marks.

SUMMARY OF THE INVENTION

It is an object of the present invention to reduce the above-described conspicuousness of dirt or the like on the top surface and to provide some protection for the top surface of the cooking panel, while providing the above-described colored impression in a simple manner.

This object and others, which will be made more apparent hereinafter, are attained in a cooking unit comprising a glass-ceramic panel made of transparent colorless bulk material or, alternatively, a glass panel made of pre-stressed special transparent colorless glass material. The glass-ceramic or glass panel provides the cooking surface and has cooking zones heated with respective radiant heating elements. A decoration is applied to the glass-ceramic or glass panel and its underside has an IR permeable coating of a temperature-resistant paint.

According to the invention the IR permeable coating provided on the underside has a solid or plain color and the upper side of the glass-ceramic or glass panel is provided with a full surface decorative coating. This combination of features makes it possible to obtain the desired predetermined color impression, which otherwise could only be provided by making the glass or glass-ceramic panel with a very expensive colored glass melt.

According to an important embodiment of the invention the paints or pigments of the solid-colored coating on the underside and of the full surface decorative coating are selected, when viewed from the top, so as to provide a white or creamy white or bisque-like color impression.

The creamy white or bisque-like color impression particularly reduces the conspicuousness of dirt or the like marks, such as fingerprints, on the top surface of the cooking panel. The topside full surface decorative coating further provides protection from upper surface scratches, metal abrasion and usage marks.

According to one embodiment of the invention temperature-resistant paints are printed and burned-in. These methods of printing allow a simple and thus economical production of the glass or glass-ceramic panel with the decoration. In the case of the glass-ceramic panel the colored coating has a typically nap or nub structure.

According to a preferred embodiment of the invention the temperature-resistant paints contain colloidal metals and/or are based on metal and/or noble metal compounds dissolved in organic solvent, the so-called lustrous pigments, noble metal resins. They are can be "organometallic" paints generally, or organometallic paints, which can particularly also contain any pigment and paints with a sol-gel matrix base, which either have a characteristic color and/or can be any arbitrary additional pigment or mixture of pigments.

The above-mentioned organometallic paints, lustrous paints, noble metal resinates, and/or also arbitrarily pigmented organometallic paints, lustrous paints, noble metal resinates can be used in the cool regions of the cooking surface. Also organic paints, colored lacquers, paints based on organically modified glasses and/or paints, which comprise an organic binder matrix or sol-gel matrix can be used on the cool regions. Conventional organic pigments, or inorganic pigments, lustrous, metallic effect, pearlescence or interference pigments, or different mixtures of these pigments, may also be used on the glass or glass-ceramic panel in the cool regions of the cooking surface. The first-named "organometallic" paints and paints based on a sol-gel matrix have the required temperature-resistance, in order to be able to permanently resist direct radiation by the radiant heating elements heating the cooking zones.

The above-described paints are burned-in at different temperatures, depending on the paint material selected.

According to another embodiment of the invention to obtain special color effects in a few cases decorations formed from the above-described organometallic solutions of metallic and/or noble metallic components, which usually provide satisfactory coverage, are backed with organic paints or other paints. These other paints comprise an organic, preferably polymeric, binder matrix or matrix on a sol-gel basis and contain conventional inorganic pigments, lustrous pigments, metal effect pigments, pearlescence pigments or interference pigments or different mixtures of these pigments.

According to the required temperature-resistance, i.e. depending on whether the decoration is applied in the heated zones or in the cool region of the cooking surface, combinations of different paints are used according to the particular embodiment of the invention. Then basically each of the above-mentioned paints can be used individually and, in so far as they are compatible with each other, in combination with each other. The temperature-resistance of the individual color types, the degree of transparency of the paint coating and the desired color impression influence the range of applications and the color combination.

The paint formed from an organometallic solution with metallic and/or noble metal components can itself be mixed with conventional inorganic pigments, lustrous pigments, metal effect pigments, pearlescence pigments or interference pigments to produce special new effects. This paint is backed as required with organic paints, paint lacquers, paints based on organically modified glasses and/or paints, which comprise an organic, preferably polymeric, binder matrix or matrix on a sol-gel basis.

Combinations of transparent lustrous paints with noble metal paints as backing, especially in the cool regions, are conceivable.

The above-mentioned "organometallic" paints or a combination of these paints with organic paints, a paint lacquer, a paint based on organically modified glasses or with paints, which comprise an organic, preferably polymeric, binder matrix or a matrix comprising a sol-gel basis and conventional inorganic pigments or different mixtures of these pigment are selected for use according to the required temperature resistance, i.e. depending on whether or not the paint is used in the heated zones or the cool regions of the cooking surface.

According to a further embodiment of the invention the underside coating is applied by a multiple printing of multiple layers. This has the advantage that the degree of transmission can be adjusted according to the number of printed layers in the multi-layer printing, whereby especially functional areas, such as display windows, can be produced on the cooking surfaces.

According to an additional embodiment of the invention the cooking device or unit is provided with a glass or glass-ceramic panel that has a laminated foil in the cool region. For example, this laminate foil can be a thin aluminum foil, a temperature-resistant polyester or melamine resin foil, which is applied with a highly transparent adhesive. A coating of temperature-resistant paint is only applied in the hot cooking zone regions. This latter coating can be a single layer or multi-layer noble metal paint layer and/or lustrous paint layer. The latter paint layer is preferred because it has a higher IR transparency.

BRIEF DESCRIPTION OF THE DRAWING

The objects, features and advantages of the invention will now be illustrated in more detail with the aid of the following description of the preferred embodiments, with reference to the sole accompanying figure which is a schematic cross-sectional view through a cooking device or unit according to the invention.

DETAILED DESCRIPTION OF THE INVENTION

The cooking device or unit shown in FIG. 1 has a glass-ceramic panel 1 which provides the cooking surface and consists of a transparent colorless material, i.e. it is colorless in bulk.

This glass-ceramic panel has at least one cooking zone 2, the heated region, associated with an electrically driven radiant heating element 3. The heated region 2 (indicated by dashed lines) typically has a temperature of greater than about 350° C. in operation. It is surrounded by an annular transitional zone 4 indicated with dashed lines which has a width of 0 to 25 mm. A cool region 5 is outside the transitional zone and usually has a temperature under 220° C.

The underside of the transparent glass-ceramic panel 1 is provided with a solid or plain colored coating 6 of temperature-resistant paint. This coating 6, which can be multi-layered, comprises a paint or a paint combination, which has a high temperature-resistance that is adjusted according to the region of the panel on which it is applied and its application on the panel underside occurs preferably by printing.

In the heated region 2 the coating 6 comprises a coating portion **6*a*** made from a paint, which comprises organometallic solutions of metal and/or noble metal. This paint may be a film-forming paint, which contains several noble metals—especially platinum, palladium, gold and silver—additional metallic compounds, dissolved in organic solvents, and/or which contains colloidal metals, and their additive substances, such as resins, co-solvents, and/or optional additives, which influence the color shade, color intensity, adhesion or solubility of the lustrous pigments or paints. Manufacturers of this type of paint include, e.g., Heraeus, Johnson Matthey, Cerdec. These paints are characterized by a high color intensity with little coating coverage only slightly impair the resistance or strength of the cooking surface. The temperature-resistance should be between 500 to 950° C. in operation and can range up to 1000° C. for temperature-resistant paints.

Double or multiple printing further reduces the transmission in the visible spectral range. The infrared transmission after a single printing is typically between 60 to 85%—according to the type of the glass-ceramic material and screen printing that is employed, which contributes to the heat transmission during cooking, especially using inferior cooking ware. This effect is augmented when the material of the glass-ceramic panel 1 itself already has a very high IR transparency. The firing occurs either in a primary firing step, during the so-called ceramicizing, as described in German Patent Document DE 35 05 922 C1, or in a special secondary firing at typically from 200° C. to 900° C. This secondary firing occurs preferably at about 460° C. to 650° C. for paints that are slightly temperature resistant for about 5 to 60 min and/or at about 460° C. to 900° C. for temperature-resistant paints, similarly for about 5 to 60 min. The so-called "organometallic" paints are usable in the transition region 4. Of course they can also be used in cool region 5, i.e. outside of the cooking zone 2, where the temperature load of about 350° C. at the edge of the cooking zone falls until about room temperature at the outer edge of the cooking surface.

Above all "organometallic", especially lustrous, paints are employed which have slight temperature resistance and are available in a wide color spectrum in the white/yellow range.

In a preferred embodiment another, e.g. lighter "organometallic" paint is used for color discrimination, which is backed or primed with a covering backing layer 8. The backing layer 8 is an organic paint in one embodiment. The temperature resistance of this type of paint is typically at maximum from 180° C. to 300° C. Thus an intervening space of about 0 to 25 mm between the cooking zone and the organic covering layer must be reserved. This intervening space together the usually light or bright insulation ring of the heating element 3 is used as an additional design element to designate the cooking zone, i.e. as a cooking zone marking means. This can be designated both by not printing that region and also printing it with a temperature-resistant paint.

In some embodiments paints, which contain inorganic pigments, lustrous pigments, pearlescent pigments, metal effect pigments or interference pigments or mixtures of these pigments, and which are characterized by a metallic luster, are used. The above-mentioned reservation of the intervening space can be avoided because of the considerably higher temperature resistance of from about 500° C. to 650° C. due to the use of these paints.

Other paints may be used in the cold region both in connection with the "organometallic" paints and also alone.

Different color effects in the white/yellow range are obtained with the different "organometallic" paints according to the covering paint used.

Additional possibilities for the color design are provided by addition of the so-called effect pigments. The effect pigments are lustrous, pearlescent or interference pigments, which, in contrast with conventional pigments, have layers with different refractive indices and thus do not absorb and scatter light. Instead they transmit and reflect light more or less strongly according to the layer structure. Metal effect pigments reflect light directly like a mirror. Manufacturers include e.g. Merck, Darmstadt, and BASF, Ludwigshafen, Germany as well as Mearl Corp. N.Y., U.S.A.; Karrira, OY; Porl, Finnland; Tayca, Osaka, Japan.

It has been shown that the metal effect can be increased by addition of from 0 to 20 percent by weight of metal effect pigments. Furthermore adhesion properties are considerably degraded with a higher content of the metal effect pigments, i.e. greater than 20 percent by weight), so that the preferred range is between 0.1 to 10 percent by weight.

In additional embodiments the coating portion 6*b* on the underside of the glass-ceramic panel in the cold region 5 comprises an organic paint. An additional coating layer can be required according to the coverage provided by the particular paint that is employed.

The glass-ceramic panel provided with the coating or coatings according to the invention can have a smooth surface and/or a nubbed or nobbed surface. Generally the latter type glass-ceramic panel has a greater mechanical strength. However a glass-ceramic panel having smooth surfaces on both sides has the advantage that indicating elements, such as LED-LCD signaling devices, are sufficiently readable without additional immersion layers.

The transparency of the glass-ceramic panel can be adjusted by varying the number of layers in the vicinity of the operating zones, e.g. as in display windows.

In further embodiments of the invention a plain colored or solid colored laminated colored foil can conceivably be provided in the cool region 5 instead of a colored coating. The foil is glued with a transparent temperature-resistant adhesive to the underside of the glass-ceramic panel 1. Acrylate adhesive coatings, for example, from 3M, Co., UV-hardening adhesives, or highly transparent silicone adhesives, preferably 2K systems, can be used as the adhesive on the underside of the glass-ceramic panel 1. The laminated colored foil should be applied to the glass-ceramic panel 1 in a bubble-free application of the adhesive. The adhesive coating must compensate for any nub or nob structures (which are typically from 50 to 150 microns high). Thus the minimum coating thickness for the adhesive is 150 microns in those embodiments. The adhesive should have a sufficiently high moisture resistance since water vapor is generated during the heating of the insulating ring of the heating element 3.

The cooking surface can also be provided by a glass panel made from pre-stressed special glass, e.g. lithium aluminum silicate glass (LAS glass) or borosilicate glass, instead of by a glass-ceramic panel.

The possible coating materials for the individual sections or portions 6*a*, 6*b* of the underside coating 6 include:

1. in section 6*a* for the heated region 2:

a. lustrous paints from Heraeus, D. Johnson Matthey, N L;

b. lustrous paints, which contain conventional inorganic pigments, lustrous pigments, metal effect pigments, pearlescent pigments or interference pigments or various mixtures of these pigments;

c. sol-gel coatings or pigmented sol-gel coatings, which contain conventional inorganic pigments, lustrous pigments, metal effect pigments, pearlescent pigments or interference pigments of various mixtures of these pigments;

d. noble metal paints, resinates or other colors, which are printed thickly coated because of reduced IR transparency; and e. preferred borosilicate glass as flux with $TiO_2$ or $CeO_2$ as pigment; and 2. in section 6*b* for the cold region 5:

at least up to 350° C., i.e. printable directly adjoining the heated region (without a gap), e.g.:

a. anti-corrosion paints with metal pigments;

b. lustrous paints with temperature-stability up to 500° C., e.g. from D. Heraus; Johnson Matthey, N L;

c. lustrous paints with a temperature stability of up to 500° C. which contain conventional inorganic pigments, lustrous pigments, metal effect pigments, pearlescent pigments or interference pigments or various mixtures of these pigments;

d. noble metal paints, resinates with a temperature stability of up to 900° C., e.g. from Johnson Matthey, D. Heraus, Cerdec;

e. sol-gel coatings or pigmented sol-gel coatings, which contain conventional inorganic pigments, lustrous pigments, metal effect pigments, pearlescent pigments or interference pigments of various mixtures of these pigments; and up to 300° C., f. organic paints with inorganic coloring agents, e.g. colored lacquers or hydroglasses from Diegel, Alsfeld, D.; and up to 180° C. to 220° C., g. organic paints with organic coloring agents, e.g. from D. Heraus;

h. paint based on organically modified glasses;

i. laminated foils, e.g. aluminum foils, polyester foils, melamine resin foils;

Furthermore all conceivable combinations of the coating materials described in section 1 and 2 above, e.g. in the cold region 2*b*+2*f*, 2*c*+2*f*, 2*b*+2*a*, 2*b*+2*d*, 2*b*+2*e*, etc., can be used.

In the different embodiments the coatings are fired, dried and/or hardened. according to the type of coating.

In addition to the underside solid or plain colored coating 6 the topside of the glass-ceramic panel 1 is provided with a full surface decorative coating 7, which preferably extends over the hot and cold regions 2, 5 in the same way. This decorative coating 7 preferably is formed according to the disclosures in German Patent Document DE 197 28 881 C1. This decorative coating comprises ceramic paints of this type printed on the topside of the glass-ceramic panel in a screen printing method so that at least two complementary grid-like structures sit in a side-by-side relationship and together provide a closed, full surface or completely covering decorative coating. This decorative coating is preferably a solid or plain color and comprises a colored layer with borosilicate glass as the glass flux and ceramic pigments comprising $TiO_2$ and/or $CeO_2$. A glass paint, which has $SiO_2$ and $Al_2O_3$ as the principal ingredient, corresponding to German Patent Document DE 197 21 737, can also be used.

The paint pigments of the solid or plain underside coating 6 and the full surface topside decorative coating 7 are selected so that alternatively a white, coated white, creamy white or bisque color impression is created when the coated glass-ceramic panel 1 is viewed from above.

The term "temperature-resistant" herein means the same as "heat-resistant".

The disclosure in German Patent Application 200 19 210.8 of Nov. 11, 2000 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a glass-ceramic or glass panel made of transparent colorless bulk material and provided with an ir permeable solid colored underside coating, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A cooking unit with a glass-ceramic panel or a glass panel (1), said glass-ceramic panel consisting of transparent colorless glass-ceramic material, said glass panel consisting of pre-stressed transparent colorless glass material, said glass-ceramic panel or said glass panel providing a cooking surface of the cooking unit and said cooking surface having cooking zones heated with respective radiant heating elements (3), wherein said glass-ceramic panel or said glass panel has an upper side provided with a full surface decorative coating (7) and a solid colored or plain colored IR permeable coating (6) on an underside of said glass-ceramic panel or said glass panel.

2. The cooking unit as defined in claim 1, wherein said IR permeable coating (6) and said full surface decorative coating (7) comprise paint pigments selected so that a white, creamy white or bisque colored impression is provided when said glass panel or glass-ceramic panel is observed from above.

3. The cooking unit as defined in claim 1, wherein said solid colored or plain colored IR permeable coating (6) is made from a first temperature-resistant coating material having a temperature resistance greater than about 350° C. in a heated region (2) of the glass or glass-ceramic panel and is made from a second temperature-resistant coating material having a temperature-resistance to temperatures of up to about 350° C. in a cool region (5) of the glass or glass-ceramic panel.

4. The cooking unit as defined in claim 3, wherein said temperature resistance of said first temperature-resistant coating material is greater than about 500° C.

5. The cooking unit as defined in claim 3, wherein said IR permeable coating (6) comprises, at least in said heated region (2), a paint and said paint comprises organometallic solutions of at least one member selected from the group consisting of complex metal components, colloidal metal components and noble metal components, which contain pigments or mixtures of pigments, and wherein said noble metal components include noble metal resinates and lustrous pigments.

6. The cooking unit as defined in claim 3, wherein said IR permeable coating (6) comprises, at least in said heated region (2), a sol-gel coating and said sol-gel coating contains pigments or mixtures of pigments.

7. The cooking unit as defined in claim 3, wherein said IR permeable coating (6) comprises, at least in at least one of said cool region (5) and a transitional region (4) between said heated region (2) and said cool region (5), lustrous paint or organometallic paint having said temperature resistance to said temperatures up to about 350° C., said lustrous paint or said organometallic paint containing pigment, as needed.

8. The cooking unit as defined in claim 7, wherein said organometallic paint is selected from the group consisting of noble metal resinates; anti-corrosive paints, pigmented as needed; and sol-gel layers, pigmented as needed.

9. The cooking unit as defined in claim 3, wherein said IR permeable coating (6) comprises, at least in at least one of said cool region (5) and a transitional region (4) between said heated region (2) and said cool region (5), organic paint having said temperature resistance at temperatures up to about 300° C., said organic paint comprising organic lacquers, organic-modified glasses or other organic paints comprising an organic binder or sol-gel matrix and at least one pigment ingredient selected from the group consisting of inorganic pigments, lustrous pigments, metal effect pigments, pearlescent pigments and interference pigments.

10. The cooking unit as defined in claim 9, wherein said organic binder matrix comprises an organic polymer.

11. The cooking unit as defined in claim 5, wherein said IR permeable coating (6) comprises a combination of said first and second temperature-resistant coating materials in said heated region, said cool region and in a transitional region between said heated region and said cool region.

12. The cooking unit as defined in claim 1, wherein said IR permeable coating (6) comprises a multi-layered coating.

13. The cooking unit as defined in claim 1, wherein said IR permeable coating (6) is backed or primed with a covering backing layer (8) made from a paint different from that of said IR permeable coating (6).

14. The cooking unit as defined in claim 1, wherein said IR permeable coating (6) on said underside only extends over a heated region (2) of said glass-ceramic panel (1) or said glass panel, said IR permeable coating (6) comprises a temperature-resistant paint and further comprising a foil applied to and extending over said underside of said glass-ceramic panel (1) or said glass panel in a cool region (5) thereof.

15. The cooking unit as defined in claim 14, wherein said foil is selected from the group consisting of plastic foils, stainless steel foils and aluminum foils.

16. The cooking unit as defined in claim 15, wherein said plastic foils comprise polyester foils and melamine resin foils laminated with a transparent adhesive.

* * * * *